US005588727A

United States Patent [19]

D'Agaro et al.

[11] Patent Number: 5,588,727

[45] Date of Patent: Dec. 31, 1996

[54] DESKTOP ORGANIZER FOR AN OFFICE WORKSTATION

[75] Inventors: Amos D'Agaro, Udine; Adriano Marino, Novara; Andrea Venturini, Udine, all of Italy

[73] Assignee: Exponent Italia S.r.L., Udine, Italy

[21] Appl. No.: 417,114

[22] Filed: Apr. 5, 1995

[30] Foreign Application Priority Data

Nov. 3, 1994 [IT] Italy ..... PN940039 U

[51] Int. Cl.[6] ..... A47B 97/00

[52] U.S. Cl. ..... 312/283; 312/301; 312/330.1; 312/223.3; 312/287; 248/918; 248/442.2

[58] Field of Search ..... 312/208.1, 283, 312/270.3, 301, 330.1, 348.5, 287, 289, 317.3, 322, 223.3, 351.6, 351.9, 348.4; 108/50, 102; 248/917, 918, 442.2, 346.5, 188.9, 649, 282.1, 314

[56] References Cited

U.S. PATENT DOCUMENTS

| | | | |
|---|---|---|---|
| 498,974 | 6/1893 | Harkinson | 312/330.1 X |
| 2,604,369 | 7/1952 | Phillips et al. | 312/322 |
| 2,615,776 | 10/1952 | Lorentzen | 312/289 |
| 3,285,685 | 11/1966 | Hewett | 312/287 |
| 3,717,395 | 2/1973 | Spieluogel et al. | 312/283 X |
| 4,491,375 | 1/1985 | Ugalde | 312/283 |
| 4,496,200 | 1/1985 | Hagstrom et al. | 312/208.1 |
| 4,570,793 | 2/1986 | O'Neil et al. | 206/371 |
| 4,582,285 | 4/1986 | Bello | 248/442.2 |
| 4,657,214 | 4/1987 | Foster | 708/102 X |
| 4,709,972 | 12/1987 | LaBudde et al. | 312/208.1 |
| 4,931,978 | 6/1990 | Drake et al. | 364/708 |
| 5,122,941 | 6/1992 | Gross et al. | 248/918 X |
| 5,161,870 | 11/1992 | Mason et al. | 312/348.4 |
| 5,205,631 | 4/1993 | Wegman et al. | 312/208.1 X |
| 5,213,401 | 5/1993 | Hatcher | 312/208.1 |
| 5,265,735 | 11/1993 | Hassel et al. | 211/11 |

FOREIGN PATENT DOCUMENTS

| | | | |
|---|---|---|---|
| 2056775 | 5/1992 | Germany | 312/283 |

*Primary Examiner*—Peter M. Cuomo
*Assistant Examiner*—James O. Hansen
*Attorney, Agent, or Firm*—Wenderoth, Lind & Ponack

[57] ABSTRACT

A desktop organizer is designed so as to organize the components, such as a computer and related supplies and accessories, of a workstation in a compact space and at locations which the user will find convenient. The organizer includes a container in the form of a box having a rigid upper member on which the monitor of the computer can be supported, runners disposed within the container and extending orthogonally to each other, and at least one drawer housed within the container and supported by the runners so as to be withdrawable out of and pushable into the container through both the front of the container and a side of the container. A shelf or shelves for supporting paper and/or a mouse of the computer are also housed within the container. Support feet, which support the container on a working surface, include vertically extending stop catches which can be used to support the key pad of the computer in a generally vertical position when not in use. At least one swivelling bracket is mounted to the container and allows such accessories as a lamp or text support stand to be mounted thereto.

20 Claims, 10 Drawing Sheets

DESKTOP ORGANIZER FOR AN OFFICE WORKSTATION

BACKGROUND OF THE INVENTION

The present invention relates to a device for organizing an office workstation comprising, in particular, at least a keyboard and a monitor of a computer.

It is common knowledge that office work has undergone a far-reaching evolution, as characterized mainly by a changeover first from the mechanical typewriter and then the electric typewriter to modern computers having sophisticated text processing systems. As a result, some sort of computer can be found practically on each office desk today, this computer basically comprising a microprocessor-based CPU, fixed-disk storage memories and related operating components, and one or two drives into which floppy and/or program disks are inserted. A monitor and a keyboard, and possibly also a printer, are also connected to the CPU of the computer via electric cables, while a whole set of accessories, such as a "mouse", containers for holding disks, CDs, and cassettes, etc., a lamp, a text support stand and the like, are provided.

All such components of the office workstation are usually separated from each other and take up considerable space, thereby cluttering the workplace and becoming quite inconvenient for use by the operator.

Devices provided to organize office equipment are already known. However, these devices provide only partial and mostly dedicated solutions, and therefore turn out to be quite limited in their usefulness. For instance, U.S. Pat. No. 4,570,793 discloses a modular, knock-down desktop item holder adapted to accommodate pens, pencils, paper sheets and the like. A similar device, adapted to be attached to the keyboard of a computer, is disclosed in U.S. Pat. No. 5,265,735. U.S. Pat. Nos. 4,496,200 and 4,709,972 describe support containers for use with a computer, to or in which the related keyboard can be attached or inserted, respectively. U.S. Pat. No. 4,931,978 describes a known device for supporting a computer, in which a drawer-like keyboard-holder can be inserted, the drawer-like keyboard-holder housing, in turn, the electric connections and power controls in its rear portion.

SUMMARY OF THE INVENTION

It would therefore be desirable, and it is a main object of the present invention to provide an integrated desktop organizer which is capable of organizing all of the main elements of the workstation itself in a compact space and, above all, which enables the operator or user of the workstation to perform his/her work in a very convenient and efficient manner.

Such an object is achieved by the present invention which comprises a container which is adapted to support the monitor of a computer, and members capable of holding, supporting and positioning the various components of the workstation at locations convenient for the user. For instance, these members include at least one drawer for accommodating computer disks and/or other supplies, housed within the container and guidingly supported by runners so as to be withdrawable out of and pushable into the container through both the front of the container and a side of the container. Thus, prior to the actual set-up and use of the workstation, the supplies can be readily accessed by pulling the drawer out of the front of the container. On the other hand, during use when various computer components, such as the keyboard or other accessories, are located in front of the container, the supplies can be accessed by pulling the drawer out of the side of the container.

Other members of the desktop organizer include various shelves housed within the container and slidable out of the container through the front thereof for supporting sheets of paper and/or for providing a support for a component of the computer such as a mouse.

Support feet used to support the container on a working surface also include stop catches which are adapted to support the keyboard of the computer in a generally vertical orientation when not in use.

In addition, support brackets are mounted to the container so as to be swivelable and are adapted to support various accessories such as a lamp and/or a stand for holding text.

BRIEF DESCRIPTION OF THE DRAWINGS

Other objects, features and advantages of the present invention will be more clearly understood from the description below of a non-limiting example of the present invention, made with reference to the accompanying drawings, in which.

DETAILED DESCRIPTION OF THE PREFERRED EMBODIMENTS

Figure 1:
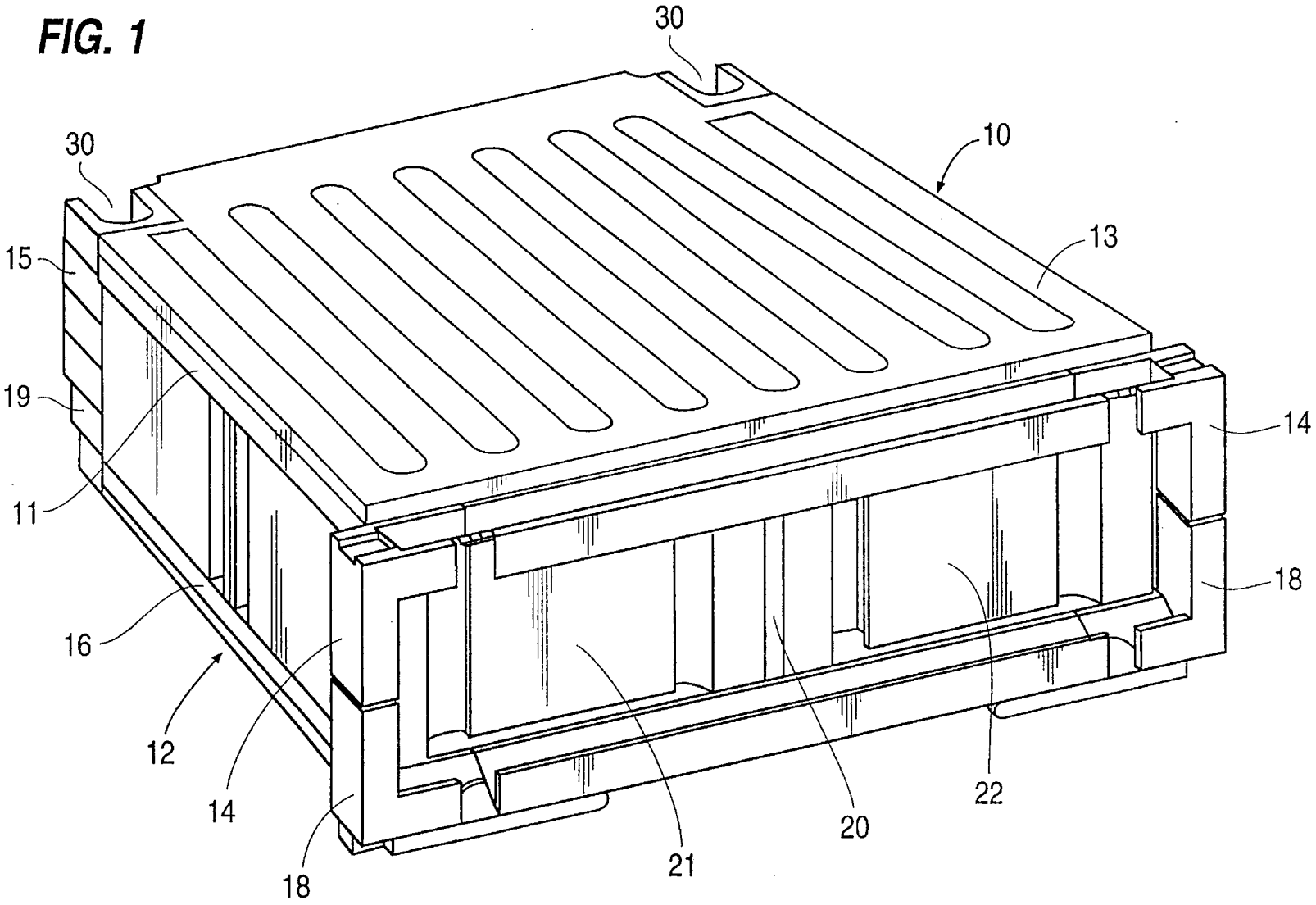
FIG. 1 is a perspective view of the desktop organizer according to the present invention.
Figure 2:
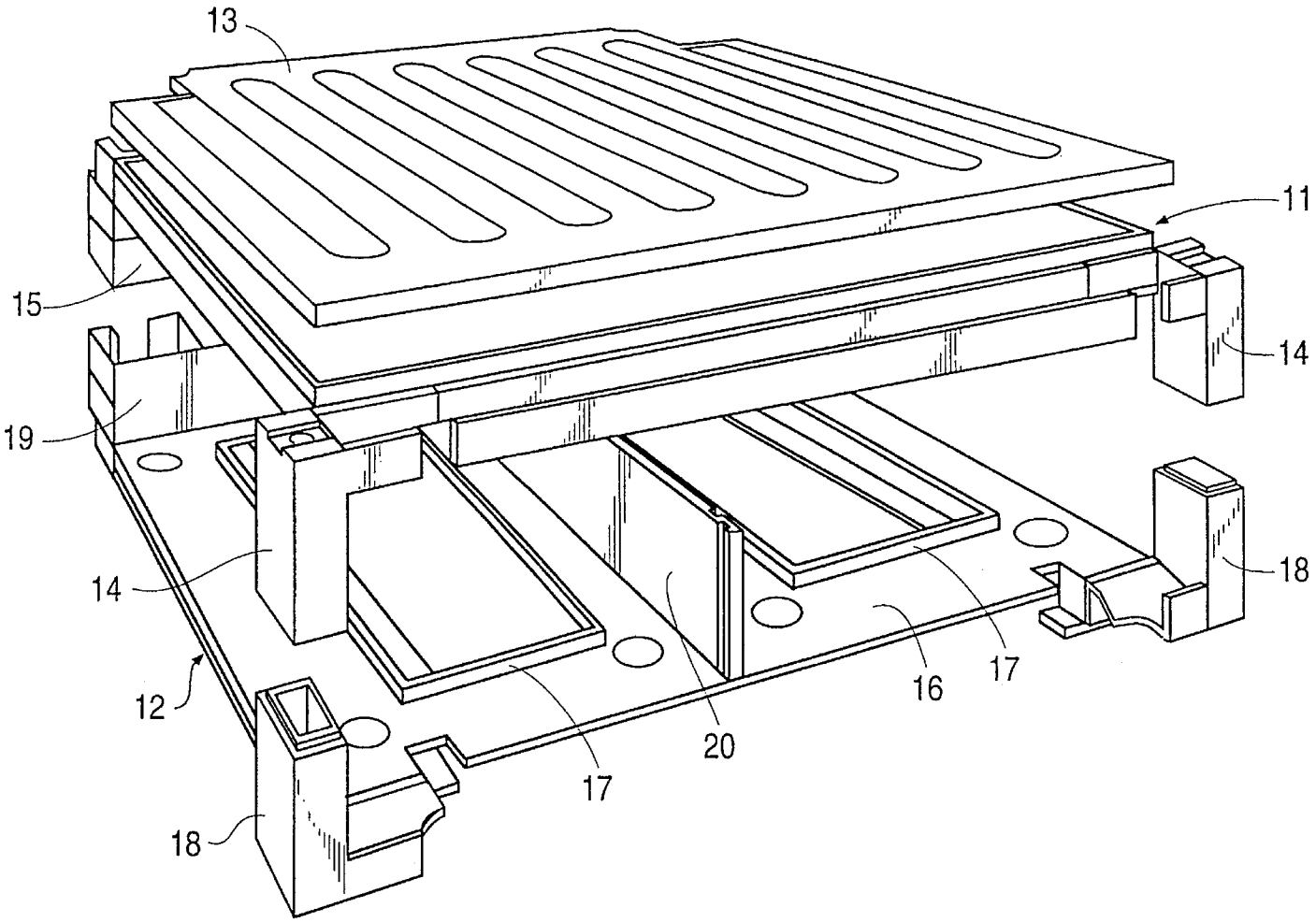
FIG. 2 is an exploded perspective view of the main structural components of the desktop organizer shown in FIG. 1.

Referring first to FIGS. 1 and 2, the desktop organizer according to the present invention is in the form of a box-like container 10 constituted by an upper frame half 11 and a lower frame half 12, the structures of which are preferably substantially identical so that the frame halves can be coupled together in a mutually opposing relation.

A rigid member 13, defining the top of the container 10, is disposed on the upper frame half 11 and is fixed thereto by, for example, spring clips. The rigid member 13 has a substantially planar upper surface on which a computer monitor is to be supported. The term "substantially" refers to the fact that the upper surface may have an anti-slip provision, such as slight ridges, that accepts and supports the monitor and prevents the monitor from sliding along the surface. The upper frame half 11 is provided with front upright angle bars 14 and a rear wall 15. The lower frame half 12 includes a planar base 16, front upright angle bars 18 and a rear wall 19.

The upright angle bars 14 and the rear wall 15 of the upper frame half 11 abut and are coupled, by any suitable means (e.g., by press-fitting, by means of inner tie-bolts, etc.) to the upright angle bars 18 and the wall 19 of the lower frame half 12, respectively, so as to form the box-like container 10.

Preferably, the lower surface (not visible) of the upper frame half 11 is provided with stiffening ribs, and a middle vertical wall 20 is interposed between the upper frame half 11 and the lower frame half 12. The middle vertical wall 20 thus divides the inner space of the box-like container 10 into two separate compartments.

Figure 3:
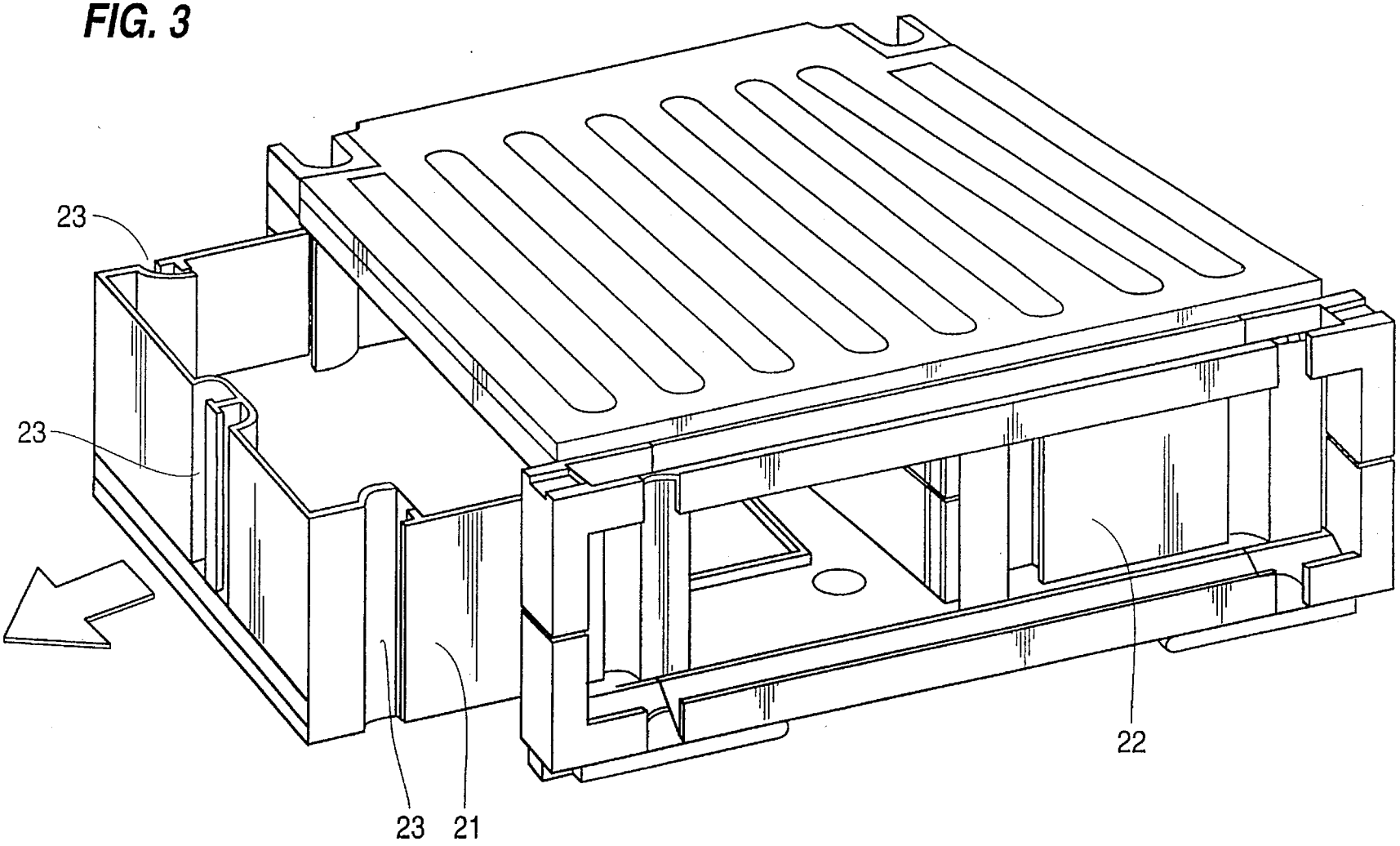
FIGS. 3 and 4 are perspective views of the desktop organizer, as illustrated in two different operational positions.
Figure 4:
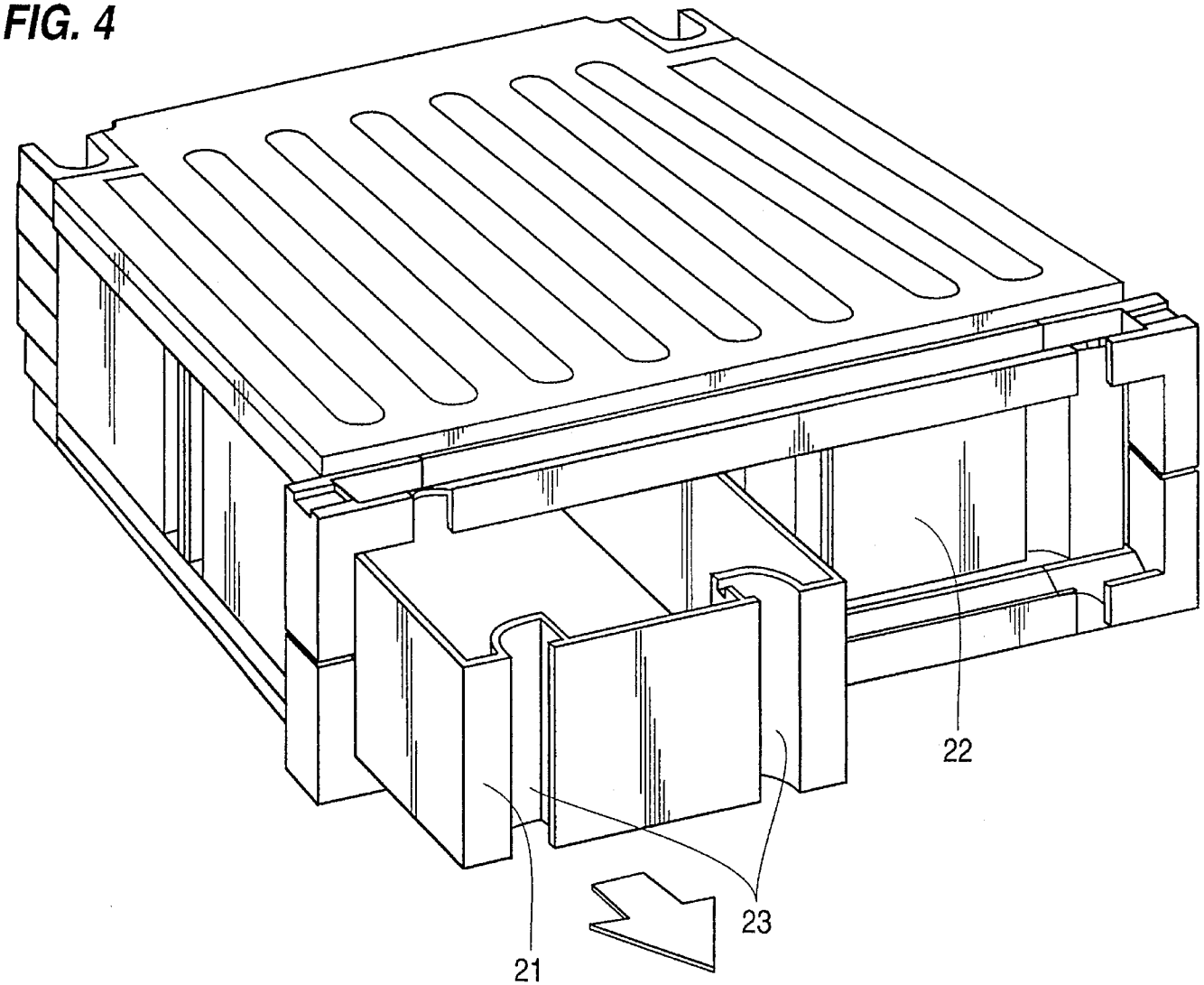

According to a main feature of the present invention, at least one and preferably two drawers 21, 22 are housed inside the container 10. The drawers are capable of sliding on guiding runners 17, which are disposed inside the container on the upper surface of the planar base 16 of the lower frame half 12. These runners 17 extend orthogonally to each other in front-to-rear and side-to-side directions of the container 10 to enable each of the drawers 21, 22 to be pushed into and pulled out of the container both frontally (FIG. 4) and laterally through a respective side of the container (FIG. 3). The drawers 21 and 22 are provided on their exposed sides with recesses 23 that define a handle facilitating gripping, holding and handling of the same. Such drawers may be internally compartmentalized, in a more or less known manner, to accommodate computer disks, CDs and the like.

Figure 5:
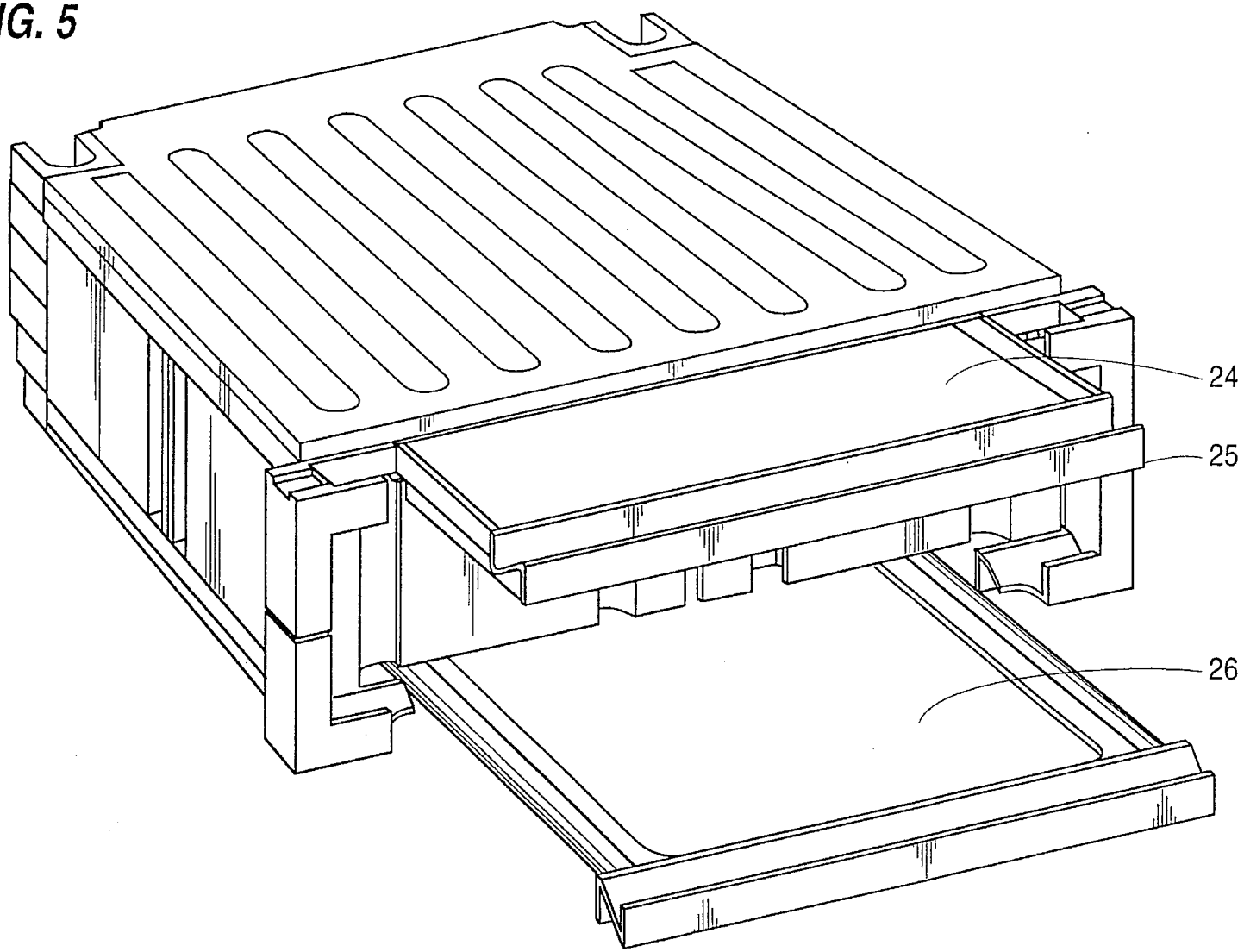
FIG. 5 is a perspective view of the desktop organizer illustrating another detail of the same.

In addition, a first extractable shelf 24, 25 (FIG. 5) is housed within the container 10 beneath the rigid member 13 and above drawers 21, 22 whereas a second extractable shelf 26 is housed within the container 10 above the planar base 16 and beneath the drawers 21, 22. The shelf 24, 25 may accommodate sheets of paper and other items (pens, pencils on the ledge 25 of the shelf) being used in conjunction with the office workstation. The shelf 26 may act as a pad on which the computer "mouse" may rest. One of these shelves may also act as a stand that can be drawn out of the box-like container 10 and positioned in the workstation as described later on.

Figure 6:
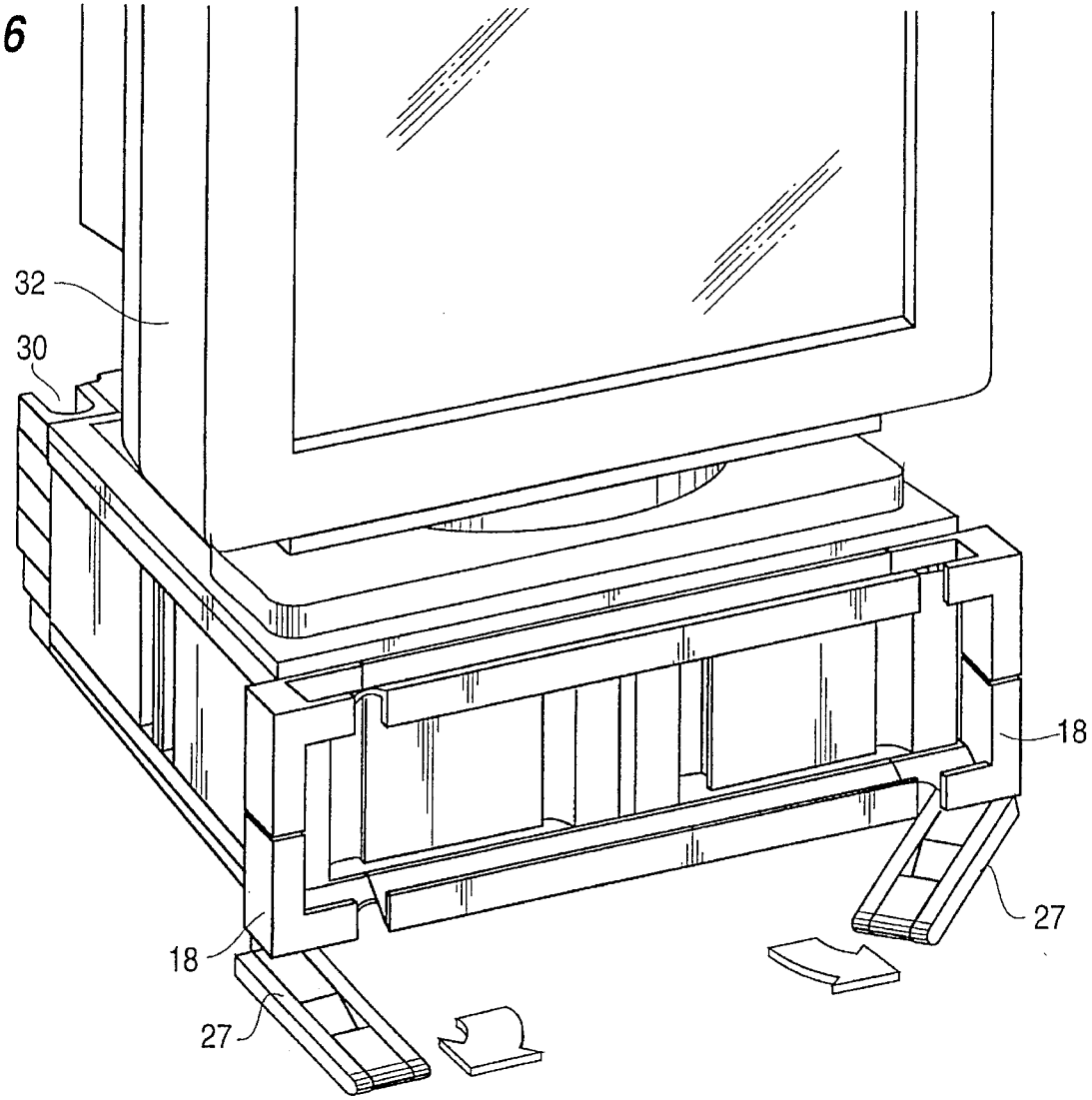
FIGS. 6 and 7 are perspective views of the desktop organizer along with an associated monitor and keyboard.
Figure 7:
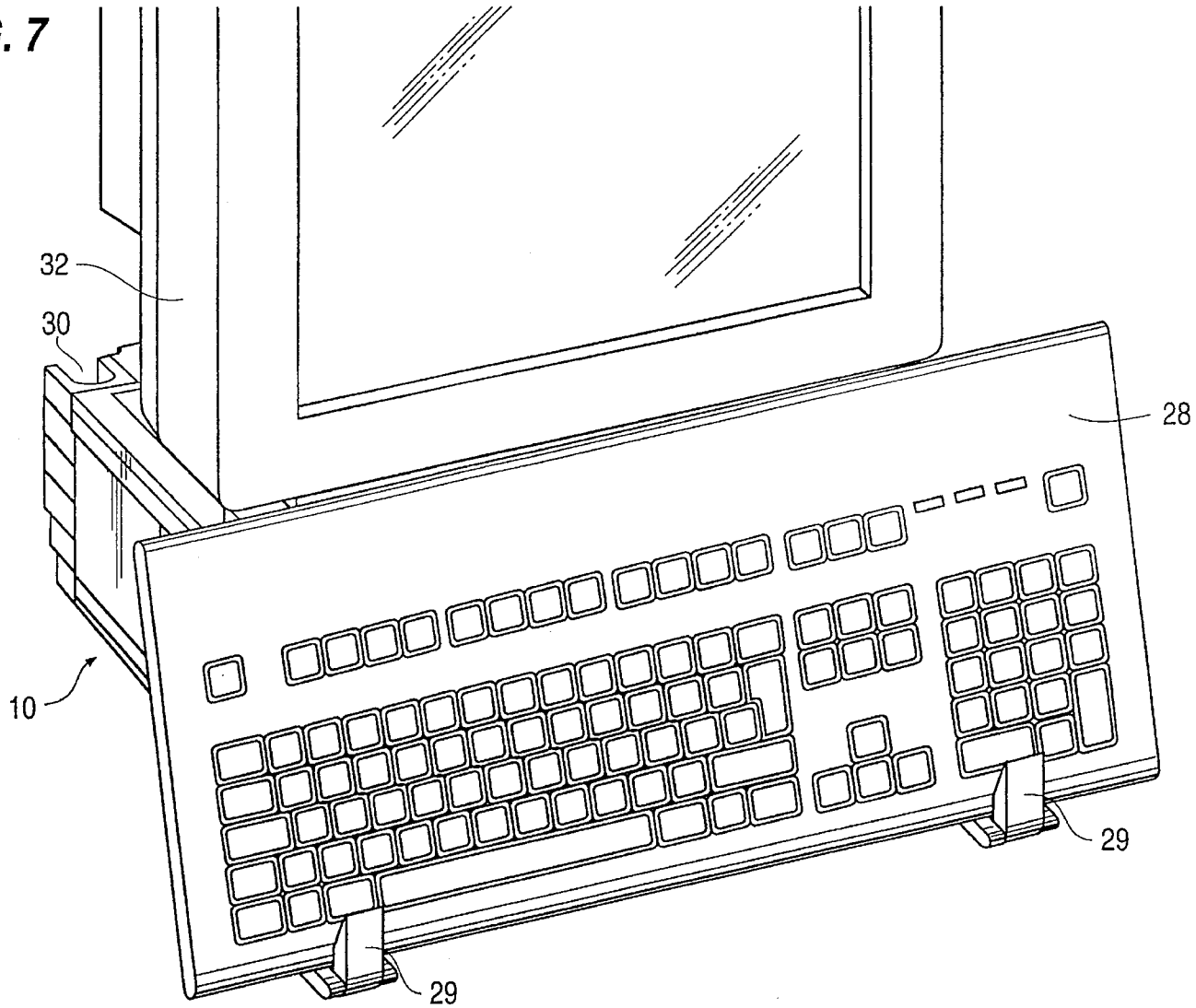

Two support feet 27 (FIG. 6) are fitted beneath the two front upright angle bars 18 of the lower frame half 12 and are capable of being swivelled between first resting positions at which they lie under the lower frame half 12 of the container as extending parallel to the front edge thereof and operative second positions at which they extend outwardly from beneath the container 10 orthogonally with respect to the resting position. In the second positions, support feet 27 are capable of supporting a keyboard 28 (FIG. 7) in a nearly vertical resting position. To this end, the feet 27 each include a base having a first free end and a second end pivotably connected to an angle bar 18, and a stop catch 29 hinged to the free end of the base so as to be pivotable between a horizontal position (FIG. 6) and a generally vertical operative position (FIG. 7).

Figure 8:
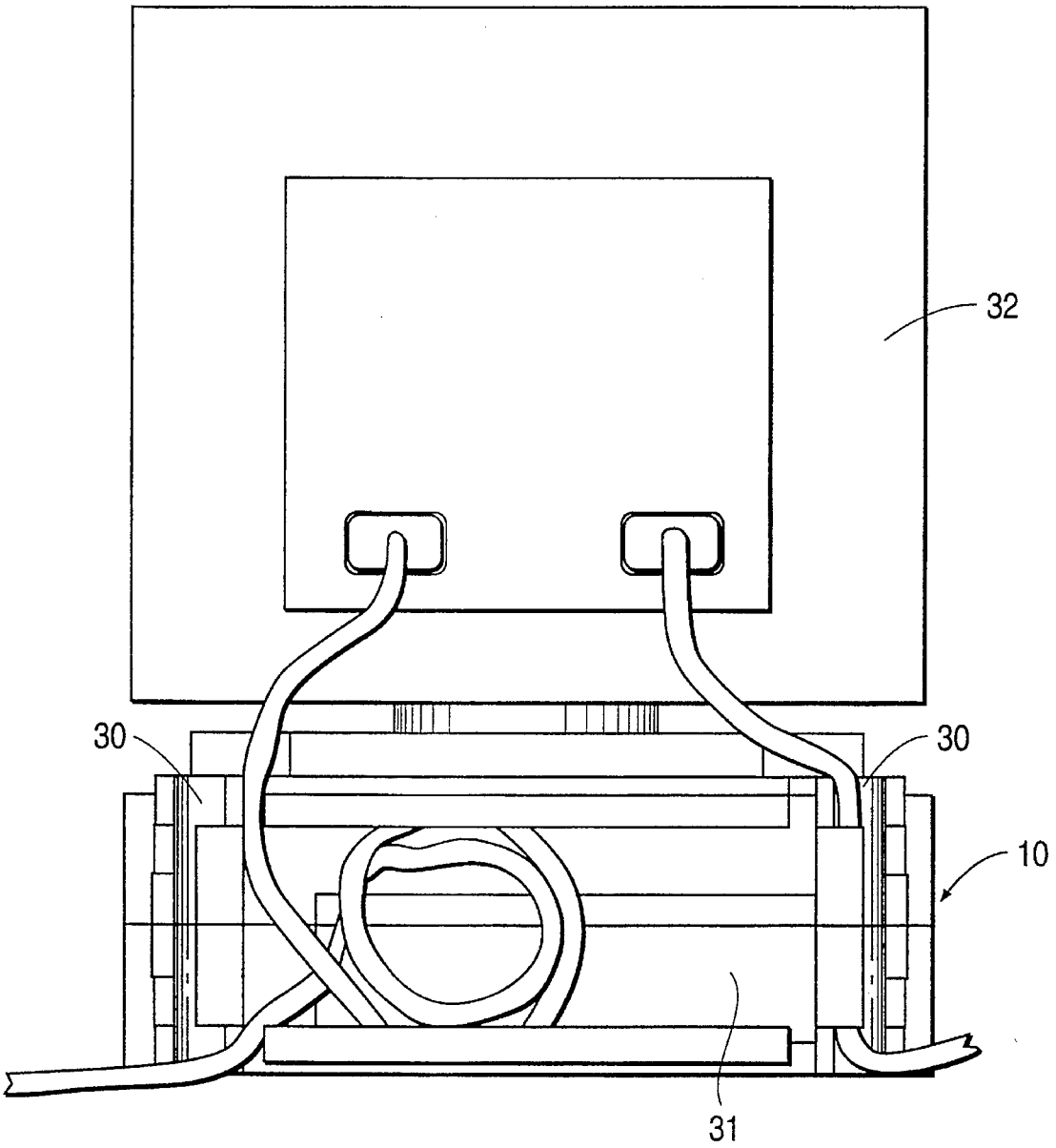
FIG. 8 is a rear view of the desktop organizer illustrated in FIGS. 6 and 7

To facilitate the integration of the desktop workstation with electronic equipment, the rear wall 15, 19 of the workstation defines at least one exposed vertically extending notch 30 and a storage compartment 31 to allow the electrical cables of a monitor 32 resting on the rigid member 13 of the container 10 to pass therethrough and to be stored therein, respectively (FIG. 8).

Figure 9:
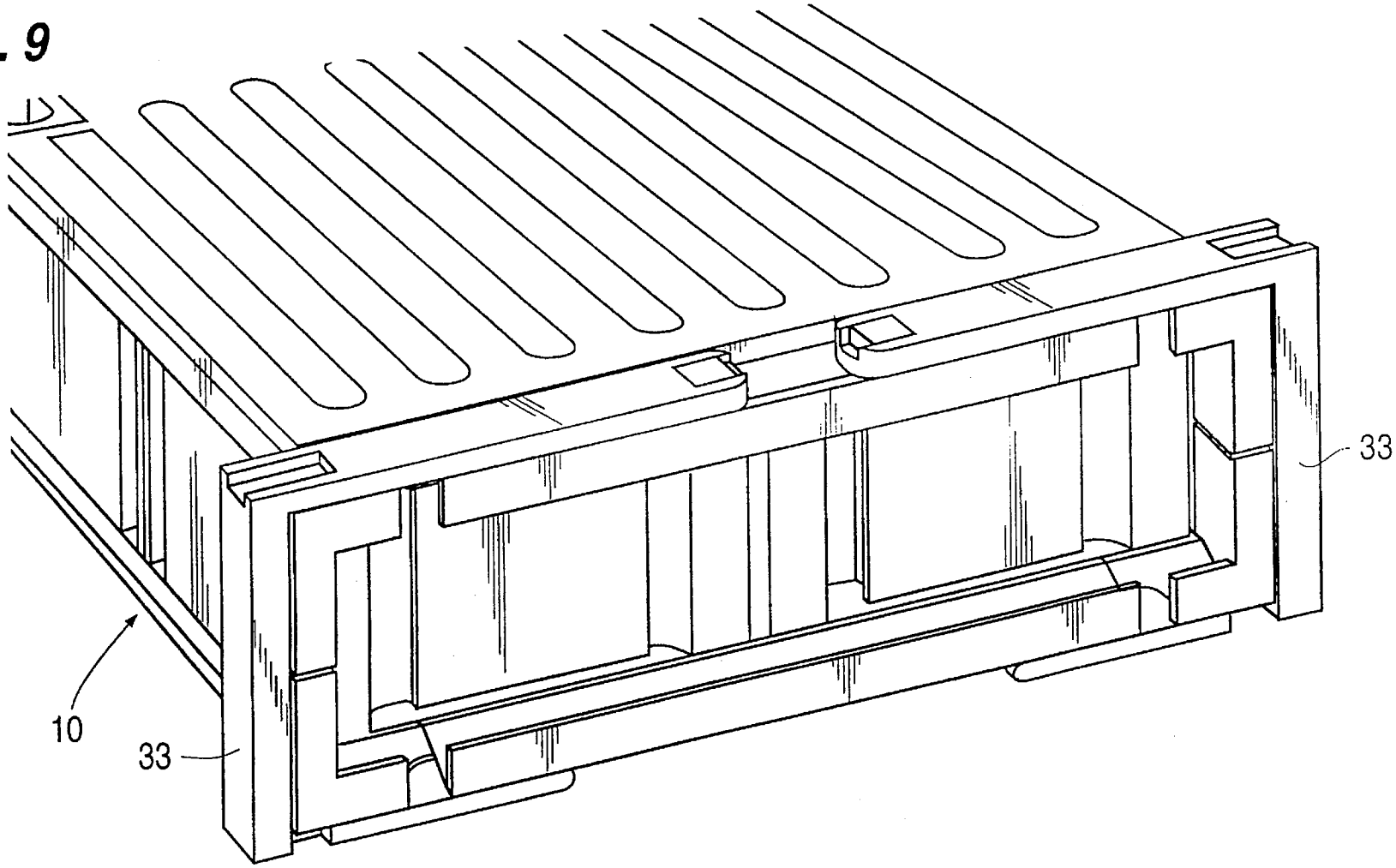
FIG. 9 is a partial perspective view of another portion of the desktop organizer shown in FIG. 1.

Finally, two preferably L-shaped brackets 33 are fitted to the front of the container 10 so as to be capable of sliding along and being swivelled with respect to the same (FIG. 9). The horizontal leg of each L-shaped bracket 33 is swivelably mounted to the top of the container 10, whereas the vertical leg of each bracket is hollow. The brackets 33, when in their resting position shown in FIG. 9, lie flush with the upper surface of the container 10 and extend alongside the respective sides of the container 10. On the other hand, in their operative position (FIG. 10) the brackets 33 protrude sideways from the container 10 and are capable of being swivelled with respect to the container.

Figure 10:
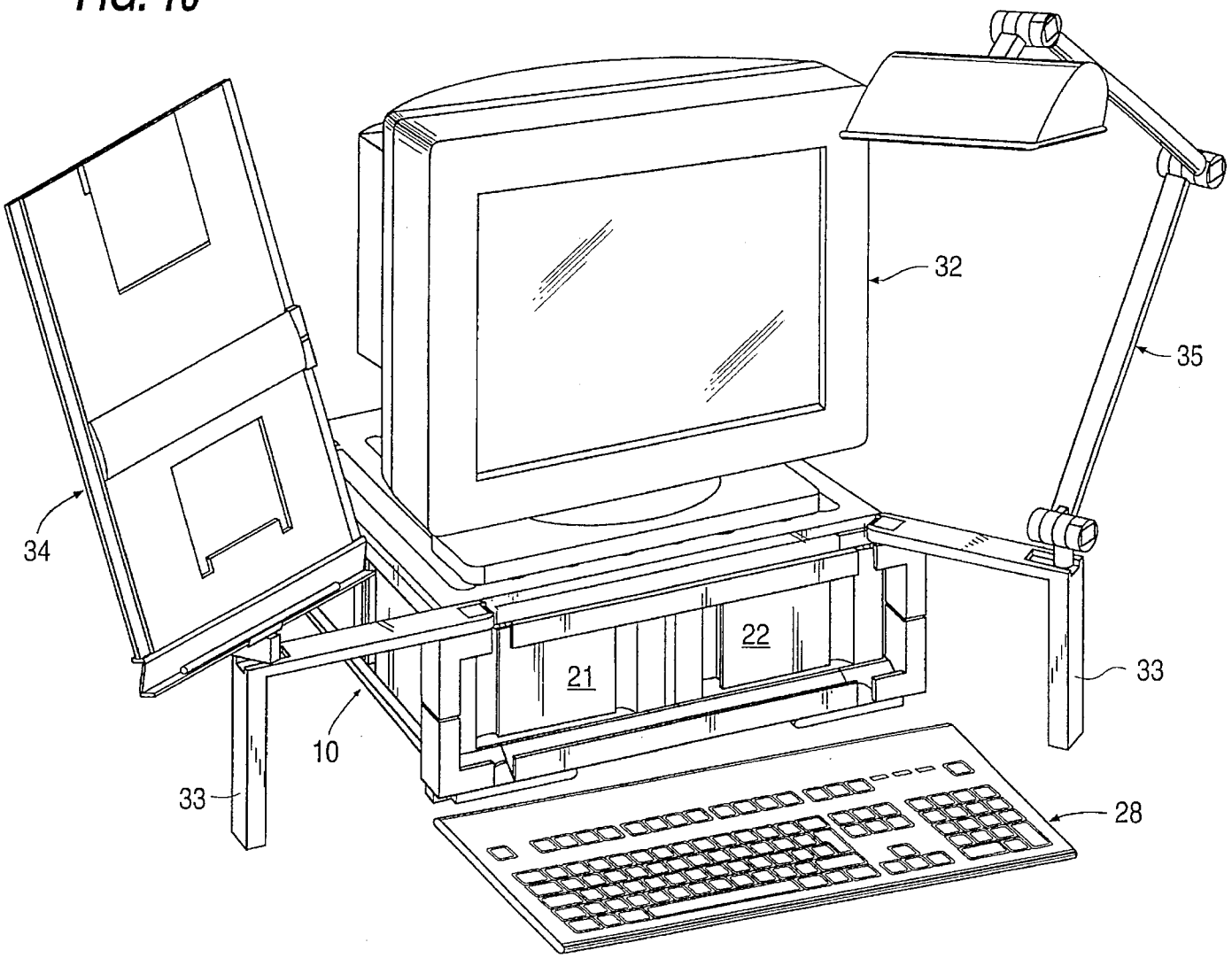
FIG. 10 is a perspective view of a desktop workstation using the desktop organizer shown in FIG. 1.

FIG. 10 illustrates a complete office workstation as organized with the desktop organizer according to the present invention. As can be seen, the container 10, as equipped with all of the above-described accessories, is supporting a computer monitor 32 while a stand 34 (which could be a shelf housed within the container 10 as alluded to earlier) and an articulated lamp 35 of a per se known type are inserted into the hollow vertical legs of the brackets 33. The drawers 21 and 22 can be extracted from the container 10 either frontally or laterally in order to gain access to the items (computer disks, CDs and the like) stored inside them.

It should be duly noted that the container 10 is sized to match the operational module of a computer, which may therefore be joined to the container 10 in a side-by-side arrangement.

As should be clear from above, the desktop organizer of the present invention confers considerable efficiency and convenience to an office workstation.

It will of course be appreciated that a number of modifications may be imparted to the desktop organizer, such as changes to its overall shape, and various additional members may be added thereto for holding, supporting and/or positioning other computer components and/or accessories, without departing from the true spirit and scope of the present invention as defined by the appended claims.

What is claimed is:

1. A desktop organizer for organizing an office workstation that includes at least a monitor of a computer, said desktop organizer comprising: a container in the form of a box having a top, a bottom, a front end, a rear end and first and second opposite sides, the front end and said first side of the container being open to the interior of the container, and the container including a rigid member having a substantially planar upper surface defining the top of the container, whereby a computer monitor can be supported on top of the container; a first runner disposed inside the container and extending in a first direction between the front end and the rear end of the container; a second runner disposed inside the container and extending in a section direction between the first and second sides of the container, said second direction being orthogonal to said first direction; and a drawer housed within said container and supported by said first and second runners so as to be pullable out of and pushable into the container through both the front end of the container and said first side of the container.

2. A desktop organizer as claimed in claim 1, wherein said container comprises an upper frame half and a lower frame half coupled to each other in a mutually opposing relation, each of said frame halves including a pair of L-shaped bars at a front portion thereof and a rear wall at a rear portion thereof, the L-shaped bars of the upper frame half abutting the L-shaped bars of the lower frame half, respectively, at locations at which the opposite sides meet the front end of the container, and the rear wall of the upper frame half abutting the rear wall of the lower frame half at the rear end of the container.

3. A desktop organizer as claimed in claim 2, wherein the abutting rear walls of the frame halves define at least one notch exposed at the rear end of the container and a storage compartment for use in accommodating and storing, respectively, power cables of a computer monitor supported on top of the container.

4. A desktop organizer as claimed in claim 2, wherein the upper frame half is constituted by said rigid member and said upper surface thereof has an anti-slip provision, and said bottom frame half includes a base defining the bottom of the container, said first and second runners being disposed at an upper surface of said base.

5. A desktop organizer as claimed in claim 1, wherein each said drawer has two sides facing the front end of the container and said first side of the container, respectively, each of said two sides having a recessed portion defining a handle by which the drawer can be grasped.

6. A desktop organizer as claimed in claim 1, and further comprising a shelf housed within said container above said drawer and beneath said rigid member, said shelf being supported by said container so as to be slidable out of said container through the front end thereof.

7. A desktop organizer as claimed in claim 6, and further comprising a second shelf housed within said container beneath said drawer, said second shelf being supported by said container so as to be slidable out of said container through the front end thereof.

8. A desktop organizer as claimed in claim 1, and further comprising a shelf housed within said container beneath said drawer, said shelf being supported by said container so as to be slidable out of said container through the front thereof.

9. A desktop organizer as claimed in claim 1, and further comprising support feet disposed beneath said container, each of said support feet including a base having a first free end and a second end pivotably mounted to the container such that the support feet are swingable between first positions at which the support feet lie under the container and second positions at which the support feet extend outwardly from beneath said container beyond the front end of the container, and a stop catch extending generally vertically from the free end of said base, whereby said support feet can support a keyboard of a computer in a generally vertical orientation.

10. A desktop organizer as claimed in claim 9, wherein said stop catch is hinged to the free end of said base of the support foot so as to be pivotable between a first position at which the stop catch is horizontal and a second position at which the stop catch extends generally vertically.

11. A desktop organizer as claimed in claim 1, and further comprising a support bracket swivelably mounted to said container.

12. A desktop organizer as claimed in claim 11, wherein said bracket is an L-shaped bracket having a horizontally extending leg at which the bracket is swivelably mounted to the top of said container and a hollow vertically extending leg, whereby an accessory can be inserted into the vertically extending leg so as to be supported by the bracket.

13. A desktop organizer as claimed in claim 1, and further comprising a third runner disposed inside the container and extending in said first direction; a fourth runner disposed inside the container and extending in said second direction; and a second drawer housed within said container and supported by said third and fourth runners so as to be pullable out of and pushable into the container through both the front end of the container and said second side of the container.

14. A desktop organizer for organizing an office workstation that includes at least a monitor of a computer, said desktop organizer comprising: a container in the form of a box having a top, a bottom, a front end, a rear end and opposite sides, the front end and at least one of the sides of the container being open to the interior of the container, and the container including a rigid member having a substantially planar upper surface defining the top of the container, whereby a computer monitor can be supported on top of the container; runners disposed inside the container, said runners extending orthogonally to each other in directions between the front end and the rear end of the container and between the opposite sides of the container, respectively; at least one drawer housed within said container and supported by said runners so as to be pullable out of and pushable into the container through both the front end of the container and a respective one of said sides of the container; and wherein said container comprises an upper frame half and a lower frame half coupled to each other in a mutually opposing relation, each of said frame halves including a pair of L-shaped bars at a front portion thereof and a rear wall at a rear portion thereof, the L-shaped bars of the upper frame half abutting the L-shaped bars of the lower frame half, respectively, at locations at which the opposite sides meet the front end of the container, and the rear wall of the upper frame half abutting the rear wall of the lower frame half at the rear end of the container.

15. A desktop organizer as claimed in claim 14, wherein the abutting rear walls of the frame halves define at least one notch exposed at the rear end of the container and a storage compartment for use in accommodating and storing, respectively, power cables of a computer monitor supported on top of the container.

16. A desktop organizer as claimed in claim 14, wherein the upper frame half is constituted by said rigid member and said upper surface thereof has an anti-slip provision, and said bottom frame half includes a base defining the bottom of the container, said runners being disposed at an upper surface of said base.

17. A desktop organizer as claimed in claim 14, wherein said at least one drawer comprises two drawers, and each of said two drawers is housed within said container and supported by said runners so as to be pullable out of and pushable into the container through both the front end of the container and a respective one of said sides of the container.

18. A desktop organizer for organizing an office workstation that includes at least a monitor of a computer, said desktop organizer comprising: a container in the form of a box having a top, a bottom, a front end, a rear end and opposite sides, the front end and at least one of the sides of the container being open to the interior of the container, and the container including a rigid member having a substantially planar upper surface defining the top of the container, whereby a computer monitor can be supported on top of the container; runners disposed inside the container, said runners extending orthogonally to each other in directions between the front end and the rear end of the container and between the opposite sides of the container, respectively; at least one drawer housed within said container and supported by said runners so as to be pullable out of and pushable into the container through both the front end of the container and a respective one of said sides of the container; and support feet disposed beneath said container, each of said support feet including a base having a first free end and a second end pivotably mounted to the container such that the support feet are swingable between first positions at which the support feet lie under the container and second positions at which the support feet extend outwardly from beneath said container beyond the front end of the container, and a stop catch extending generally vertically from the free end of said base, whereby said support feet can support a keyboard of a computer in a generally vertical orientation.

19. A desktop organizer as claimed in claim 18, wherein said stop catch is hinged to the free end of said base of the support foot so as to be pivotable between a first position at which the stop catch is horizontal and a second position at which the stop catch extends generally vertically.

20. A desktop organizer as claimed in claim 18, wherein said at least one drawer comprises two drawers, and each of said two drawers is housed within said container and supported by said runners so as to be pullable out of and pushable into the container through both the front end of the container and a respective one of said sides of the container.

* * * * *